US010629110B2

(12) United States Patent
Seo et al.

(10) Patent No.: US 10,629,110 B2
(45) Date of Patent: Apr. 21, 2020

(54) DISPLAY DEVICE INCLUDING ARRANGEMENT OF CLOCK SIGNAL LINES AND BRIDGE LINES CONNECTED TO CLOCK SIGNAL LINES

(71) Applicant: Samsung Display Co. Ltd., Yongin-si (KR)

(72) Inventors: Jung Deok Seo, Cheonan-si (KR); Haeng Won Park, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/916,267

(22) Filed: Mar. 8, 2018

(65) Prior Publication Data

US 2019/0066563 A1 Feb. 28, 2019

(30) Foreign Application Priority Data

Aug. 24, 2017 (KR) ..... 10-2017-0107032

(51) Int. Cl.
*G09G 3/36* (2006.01)
*G09G 3/20* (2006.01)
*G09G 3/3266* (2016.01)

(52) U.S. Cl.
CPC ..... *G09G 3/2003* (2013.01); *G09G 3/3266* (2013.01); *G09G 3/3677* (2013.01); *G09G 2300/0426* (2013.01); *G09G 2310/08* (2013.01); *G09G 2320/0242* (2013.01)

(58) Field of Classification Search
CPC ..... G09G 2310/00
See application file for complete search history.

(56) References Cited

U.S. PATENT DOCUMENTS 8,848,152 B2 9/2014 Mok et al.
8,860,706 B2 10/2014 Sakamoto et al.
2012/0105423 A1* 5/2012 Chung ..... G09G 3/3266 345/212
2013/0106920 A1* 5/2013 Park ..... G09G 3/3677 345/690
2017/0060317 A1 3/2017 Kim et al.
(Continued)

FOREIGN PATENT DOCUMENTS

KR 10-2011-0136188 12/2011
KR 10-2012-0120348 11/2012
(Continued)

*Primary Examiner* — Roy P Rabindranath
(74) *Attorney, Agent, or Firm* — H.C. Park & Associates, PLC

(57) ABSTRACT

A display includes: pixels arranged in a display area (DA) in a first direction (FD) and a second direction (SD), each pixel to display one of first to third colors; gate lines (GLs) extending in the FD in the DA, arranged in the SD, and connected to the pixels; a stage unit (SU) in a non-DA, the SU including stages and being connected to the GLs; clock lines (CLs) to receive signals to control the SU, the CLs extending in the SD in the non-DA and being arranged in the FD; and bridge lines connecting the CLs with the SU. First and second CLs are connected to stages connected to pixels to display the first color. Third and fourth CLs are connected to stages connected to pixels to display the second color. Fifth and sixth CLs are connected to stages connected to pixels to display the third color.

19 Claims, 7 Drawing Sheets

(56) References Cited

U.S. PATENT DOCUMENTS

| | | | |
|---|---|---|---|
| 2017/0069256 | A1 | 3/2017 | Seo et al. |
| 2018/0166024 | A1 | 6/2018 | Park et al. |
| 2018/0204499 | A1 | 7/2018 | Bae et al. |

FOREIGN PATENT DOCUMENTS

| | | |
|---|---|---|
| KR | 10-2017-0026100 | 3/2017 |
| KR | 10-2017-0027264 | 3/2017 |
| KR | 10-2017-0028000 | 3/2017 |
| KR | 10-2017-0028479 | 3/2017 |
| KR | 10-2018-0067767 | 6/2018 |

* cited by examiner

DISPLAY DEVICE INCLUDING ARRANGEMENT OF CLOCK SIGNAL LINES AND BRIDGE LINES CONNECTED TO CLOCK SIGNAL LINES

CROSS-REFERENCE TO RELATED APPLICATION

This application claims priority from and the benefit of Korean Patent Application No. 10-2017-0107032, filed Aug. 24, 2017, which is hereby incorporated by reference for all purposes as if fully set forth herein.

BACKGROUND

Field

Exemplary embodiments generally relate to a display device.

Discussion

A display device, such as a liquid crystal display device, an organic light emitting display device, etc., may include a gate driver for outputting gate signals to gate lines of a display panel, and a data driver for outputting data signals to data lines intersecting the gate lines. The gate driver and the data driver may be mounted on the display panel in the form of chips, however, other techniques may be utilized. For instance, the gate driver and/or the data driver may be directly integrated on a substrate of the display panel to reduce the overall size of the display panel and increase the productivity of manufacturing. A gate driver integrated on the substrate may include circuitry for actually generating gate signals, and signal lines for delivering driving signals to the circuitry.

The above information disclosed in this section is only for understanding the background of the inventive concepts, and, therefore, may contain information that does not form prior art.

SUMMARY

Some exemplary embodiments provide a display device capable of improving display quality through an arrangement of signal lines, which may be optimized, for delivering driving signals to circuitry of the display device.

Some exemplary embodiments provide a display device capable of improving display quality through an arrangement of signal lines, which may be optimized, for delivering driving signals to circuitry of a gate driver of the display device.

Additional aspects will be set forth in the detailed description which follows, and, in part, will be apparent from the disclosure, or may be learned by practice of the inventive concepts.

According to some exemplary embodiments, a display device includes pixels, gate lines, a stage unit, first to sixth clock lines, and bridge lines. The pixels are disposed in a display area. The pixels are arranged in a first direction and a second direction intersecting the first direction to form a matrix arrangement. Each pixel among the pixels is configured to display a color among first to third colors. The gate lines extend in the first direction in the display area. The gate lines are sequentially arranged in the second direction and are connected to the pixels. The stage unit includes stages. The stage unit is connected to the gate lines and disposed in a non-display area outside the display area. The first to sixth clock lines are configured to receive first to third clock signals and first to third clock bar signals to control the stage unit. The first to sixth clock lines extend in the second direction in the non-display area and are sequentially arranged in the first direction. The bridge lines connect the first to sixth clock lines with the stage unit. The first and second clock lines are connected to first stages among the stages, the first stages being connected to first pixels among the pixels, the first pixels being configured to display the first color. The third and fourth clock lines are connected to second stages among the stages, the second stages being connected to second pixels among the pixels, the second pixels being configured to display the second color. The fifth and sixth clock lines are connected to third stages among the stages, the third stages being connected to third pixels among the pixels, the third pixels being configured to display the third color.

According to some exemplary embodiments, a display device includes pixels, gate lines, a stage unit, first to $c^{th}$ clock lines, and bridge lines. The pixels are disposed in a display area. The pixels are arranged in a first direction and a second direction intersecting the first direction to form a matrix arrangement. Each pixel among the pixels is configured to display a color among first to third colors. The gate lines extend in the first direction in the display area. The gate lines are sequentially arranged in the second direction and are connected to the pixels. The stage unit includes stages. The stage unit is connected to the gate lines and disposed in a non-display area outside the display area. The first to $c^{th}$ clock lines are configured to receive clock signals and clock bar signals to control the stage unit. The first to $c^{th}$ clock lines extend in the second direction in the non-display area and are sequentially arranged in the first direction. The bridge lines connect the first to $c^{th}$ clock lines with the stage unit. The first to $a^{th}$ clock lines among the first to $c^{th}$ clock lines are connected to first stages among the stages, the first stages being connected to first pixels among the pixels, the first pixels being configured to display the first color. The $(a+1)^{th}$ to $b^{th}$ clock lines among the first to $c^{th}$ clock lines are connected to second stages among the stages, the second stages being connected to second pixels among the pixels, the second pixels being configured to display the second color. The $(b+1)^{th}$ to $c^{th}$ clock lines among the first to $c^{th}$ clock lines are connected to third stages among the stages, the third stages being connected to third pixels among the pixels, the third pixels being configured to display the third color. The variables a, b, and c are natural numbers that satisfy the inequality $1<a<b<c$.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
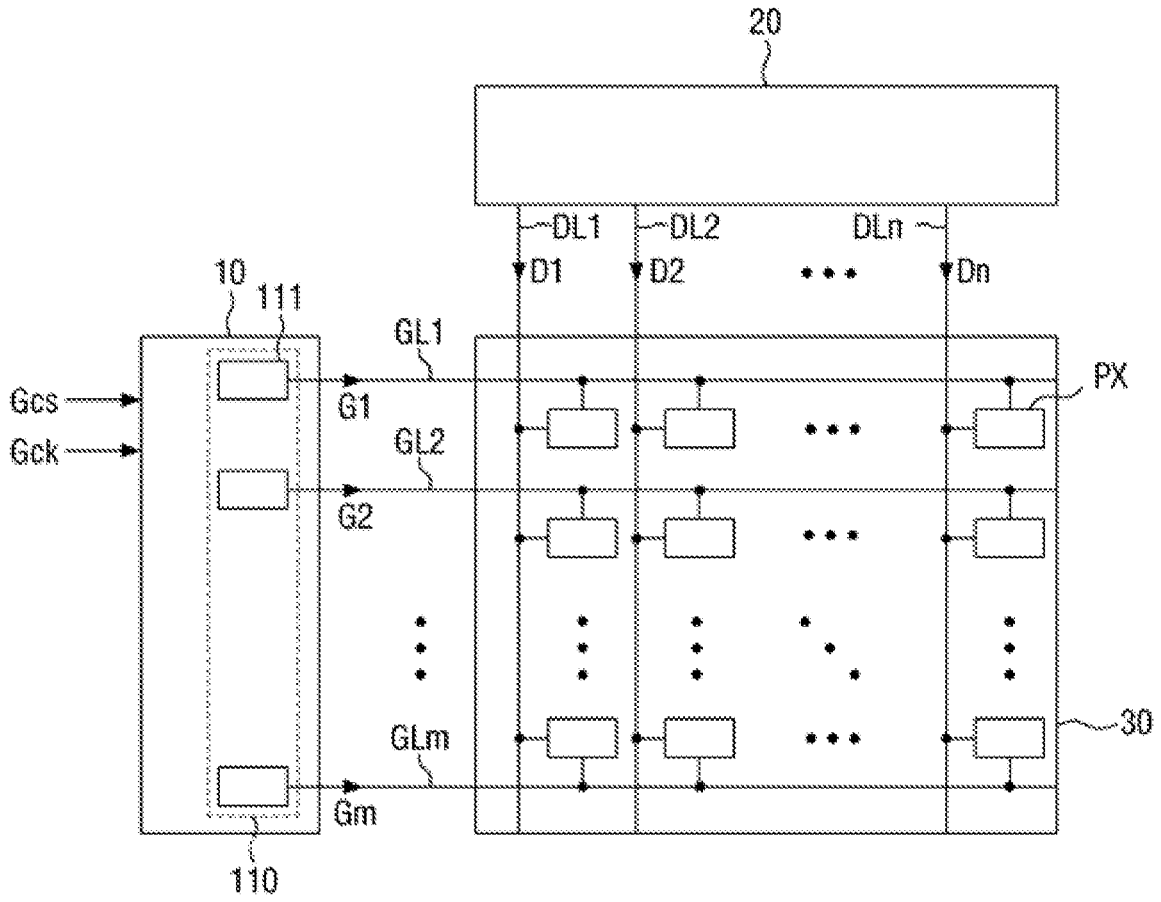
FIG. 1 is a block diagram of a display device according to some exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be implemented in another exemplary embodiment without departing from the spirit and the scope of the disclosure.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as "elements"), of the various illustrations may be otherwise combined, separated, interchanged, and/or rearranged without departing from the spirit and the scope of the disclosure.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. To this end, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the spirit and scope of the inventive concepts. Further, the blocks, units, and/or modules of some exemplary embodiments may be physically combined into more complex blocks, units, and/or modules without departing from the spirit and scope of the inventive concepts.

FIG. 1 is a block diagram showing a display device according to some exemplary embodiments.

Referring to FIG. 1, a display device includes a gate driver 10, a data driver 20, and a display (or display panel) 30.

The gate driver 10 receives a control signal Gcs for controlling the gate driver 10 from a timing controller (not shown). The control signal Gcs may include a vertical start signal (not shown) for controlling the operation of the gate driver 10 and the like. In addition, the gate driver 10 may receive a supply voltage (not shown) required for the operation of the gate driver 10 from a power supply module (not shown), and may receive a clock signal Gck for determining the output timing of the signals. The gate driver 10 may generate gate signals G1 to Gm (m being a natural number greater than zero) and may output the gate signals G1 to Gm to the gate lines GL1 to GLm sequentially.

The gate driver 10 may include a stage unit 110 including a plurality of stages 111. The control signal Gcs and the clock signal Gck provided to the gate driver 10 may be provided to the stage unit 110. Each of the stages 111 may be implemented as a shift register. A m-by-n matrix (n being a natural number greater than zero) of pixels PX is formed on the display 30 as described later, and the number of the stages 111 may be equal to the number of the rows of the matrix of pixels PX. The stages 111 may generate the gate signals G1 to Gm, respectively, using the clock signal Gck.

The data driver 20 may receive a control signal (not shown) for controlling the data driver 20 and image data (not shown) from the timing controller. The data driver 20 may convert the image data into data signals D1 to Dn, and may output the data signals D1 to Dn to the data lines DL1 to DLn, which are insulated from and intersect with the gate lines GL1 to GLm. The data signals D1 to Dn may be analog voltages corresponding to the grayscale levels of the image data.

The display 30 includes a plurality of gate lines GL1 to GLm, a plurality of data lines DL1 to DLn, and a plurality of pixels PX arranged in a matrix with m rows and n columns. The plurality of data lines DL1 to DLn and the gate lines GL1 to GLm may be arranged generally perpendicular to each other. Each of the pixels PX is connected to at least one of the plurality of gate lines GL1 to GLm and to at least one of the data lines DL1 to DLn, and may receive the gate signals G1 to Gm and the data signals D1 to Dn.

Each of the pixels PX may display a determined color, e.g., one of first to third colors. For example, each of the pixels PX may display red (R), green (G), or blue (B). A pixel PX for displaying red (R), a pixel PX for displaying green (G), and a pixel PX for displaying blue (B) may form a unit to thereby reproduce a variety of colors other than red (R), green (G), and blue (B). It is to be understood that the colors displayed by the pixels PX are not limited to red (R), green (G), and blue (B). For example, the pixels PX may display cyan, magenta, and yellow. In addition, the pixels PX may display more than three colors. For example, four pixels PX each displaying red (R), green (G), blue (B), and white (W), respectively, may form a unit to reproduce a color. For example, four pixels PX each displaying red (R), green (G), blue (B), and deep blue (DB), respectively, may form a unit to reproduce a color.

Among the plurality of pixels PX arranged in a matrix, pixels PX in the same row may display the same color. For example, the pixels PX disposed in the first row may display red (R), the pixels PX displayed in the second row may display green (G), and the pixels PX displayed in the third row may display blue (B). In this example, three consecutive pixels PX arranged in a column direction (the downward direction of FIG. 1 in which the gate lines GL1 to GLm are arranged), that is, a pixel PX displaying red (R) in the first row, a pixel PX displaying green (G) in the second row, and a pixel PX displaying blue (B) in the third row, may form a unit to reproduce a color. In this example, each area where one of the pixels PX is formed may have a longer side extending in a row direction (e.g., the direction extending from the left to the right of FIG. 1 in which the data lines DL1 to DLn are arranged).

By using the pixel structure having such a color arrangement, the number of channels used by the data driver 20 can be reduced. The number of channels used by the gate driver 10, which is equal to the number of gate lines GL1 to GLm, is increased. However, since the cost for fabricating the gate driver 10 is typically lower than the cost for fabricating the data driver 20, the cost for fabricating the display device can be reduced.

Figure 2:
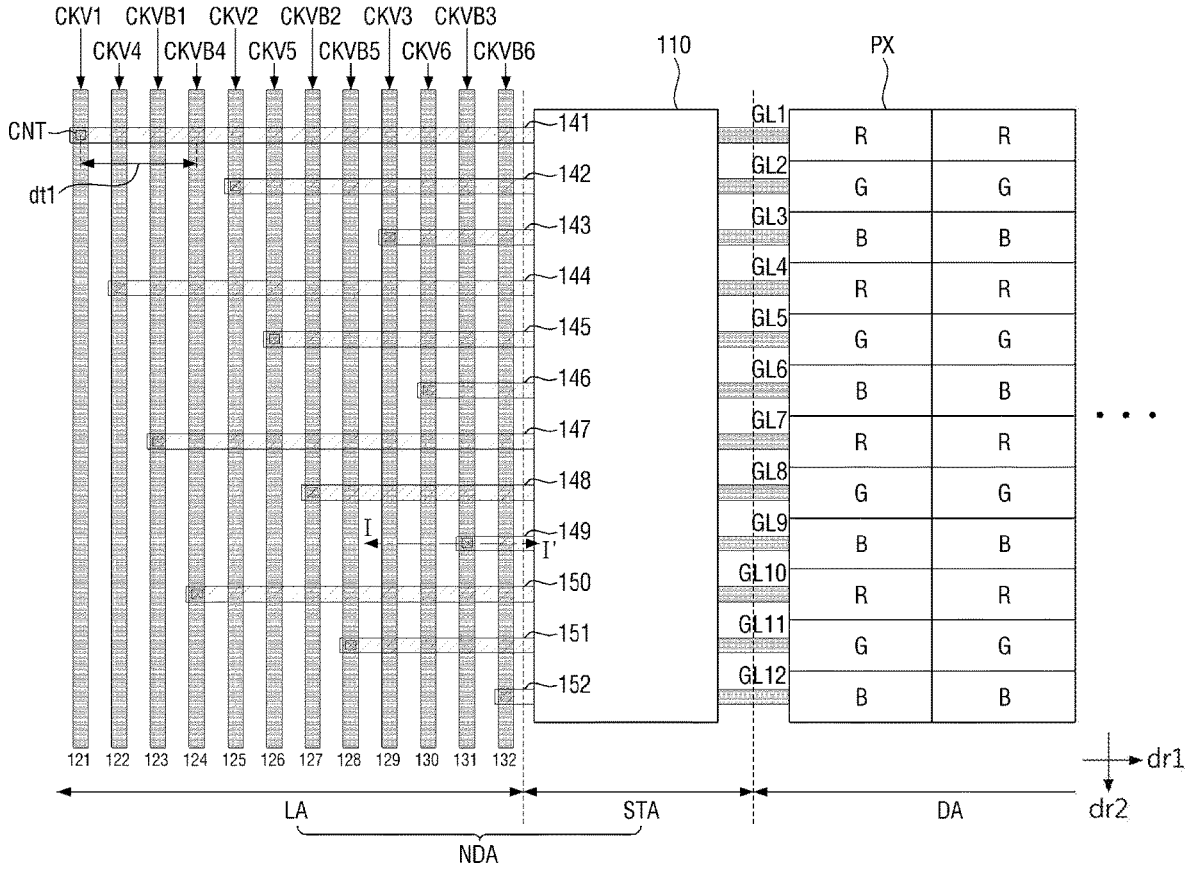
FIG. 2 is a layout diagram of a portion of the gate driver and the display of the display device of FIG. 1 according to some exemplary embodiments.

FIG. 2 is a layout diagram of a portion of the gate driver and the display of the display device of FIG. 1 according to some exemplary embodiments.

Referring to FIG. 2, the display device includes pixels PX and the first to twelfth gate lines GL1 to GL12 disposed in a display area DA. The display device also includes a stage unit 110, first to twelfth clock lines 121 to 132, and first to twelfth bridge lines 141 to 152 disposed in a non-display area NDA.

The display (or active) area DA refers to an area in which the pixels PX are arranged and images are actually displayed to a user. The display area DA may correspond to the display 30 shown in FIG. 1.

As described above with reference to FIG. 1, the pixels PX disposed in the display 30 may be arranged in a matrix of m rows and n columns. The pixels PX arranged in the same row may display the same color and consecutive pixels PX arranged in the column direction may display different colors. According to some exemplary embodiments, three consecutive pixels PX arranged in the column direction may display red (R), green (G), and blue (B), respectively, and these three pixels PX may form a unit to display one color. Each of the pixels PX may be connected to the stage unit 110 disposed in the non-display area NDA via the gate lines GL1 to GL12 extending in a first direction dr1.

Herein, the first direction dr1 is defined as a direction parallel to the row direction (that is, the direction from the left to right side in FIG. 2) in the matrix of the pixels PX formed in the display 30. On the other hand, the second direction dr2 is defined as a direction parallel to the column direction (that is, the direction from the top to bottom side in FIG. 2) in the matrix of the pixels PX formed in the display 30. The first direction dr1 may intersect with the second direction dr2.

The non-display area NDA is an area surrounding the display area DA, and a variety of elements for driving the pixels PX are disposed therein. In the non-display area NDA, the gate driver 10, the data driver 20, and the like may be integrated or mounted. As seen in FIG. 2, the structure in which elements of the gate driver 10 are disposed in the non-display area NDA illustrated. The non-display area NDA includes a line area LA where lines for providing a variety of signal to the gate driver 10 are disposed, and a stage area STA where the stage unit 110 is disposed. The stage area STA may be disposed between the line area LA and the display area DA.

As described above with reference to FIG. 1, the stage unit 110 includes a plurality of stages 111 each associated with the respective gate lines GL1 to GL12. Each of the stages 111 may receive first to sixth clock signals CKV1 to CKV6 and first to sixth clock bar signals CKVB1 to CKVB6 from the first to twelfth clock lines 121 to 132 disposed in the line area LA, and may generate the gate signals G1 to G12 provided to the gate lines GL1 to GL12, respectively, by using the first to sixth clock signals CKV1 to CKV6 and the first to sixth clock bar signals CKVB1 to CKVB6. For example, the stage unit 110 may receive the first clock signal CKV1 from the first clock line 121 to provide the first gate signal G1 to the first gate line GL1. It is to be understood that the stage unit 110 may use other clock signals than that from the first clock line 121 to generate the first gate signal G1 (for example, the second to sixth clock signals CKV2 to CKV2 and the first to sixth clock bar signals CKVB1 to CKVB6). However, also in this case, the first clock signal CKV1 may have the greatest influence in generating the first gate signal G1.

In the line area LA, the first to twelfth clock lines 121 to 132 and the first to twelfth bridge lines 141 to 152 are disposed.

The first to twelfth clock lines 121 to 132 may extend in the second direction dr2 and may be sequentially arranged in the first direction dr1. The first to the twelfth clock lines 121 to 132 may receive the first to sixth clock signals CKV1 to CKV6 and the first to sixth clock bar signals CKVB1 to CKVB6 from an external source (not shown), and may provide them to the first to twelfth bridge lines 141 to 152.

The first to twelfth bridge lines 141 to 152 may extend in the first direction dr1 and may be sequentially arranged in the second direction dr2. The first to twelfth clock lines 121 to 132 may receive the first to sixth clock signals CKV1 to CKV6 and the first to sixth clock bar signals CKVB1 to CKVB6 from the first to twelfth clock lines 121 to 132, respectively, and may provide them to the stage unit 110. The first to twelfth clock lines 121 to 132 may be insulated from the first to twelfth bridge lines 141 to 152 with an insulating layer (not shown) therebetween. The first clock line 121 may be electrically connected to the first bridge line 141 via a contact hole CNT formed at their intersection by penetrating the insulating layer. Likewise, the second to twelfth clock lines 122 to 132 may be electrically connected to the second to the twelfth bridge lines 142 to 152 via contact holes, respectively.

Although FIG. 2 shows only the first to twelfth bridge lines 141 to 152 and the pixels PX arranged in twelve rows, it is to be understood that this is merely illustrative. That is, hundreds, thousands, and tens of thousands of pixel rows may be formed, along with hundreds, thousands, and tens of thousands of bridge lines. It is to be noted that even when the pixels PX are arranged over several hundreds, thousands, or tens of thousands of rows, the stage unit 110 may be driven by the first to twelfth clock lines 121 to 132 shown in FIG. 2.

Prior to describing the connection between the first to sixth twelfth clock lines 121 to 132 and the first to twelfth bridge lines 141 to 152, the first to sixth clock signals CKV1 to CKV6 and the first to sixth clock bar signals CKVB1 to CKVB6 will be described. The description will be made with reference to FIG. 3.

Figure 3:
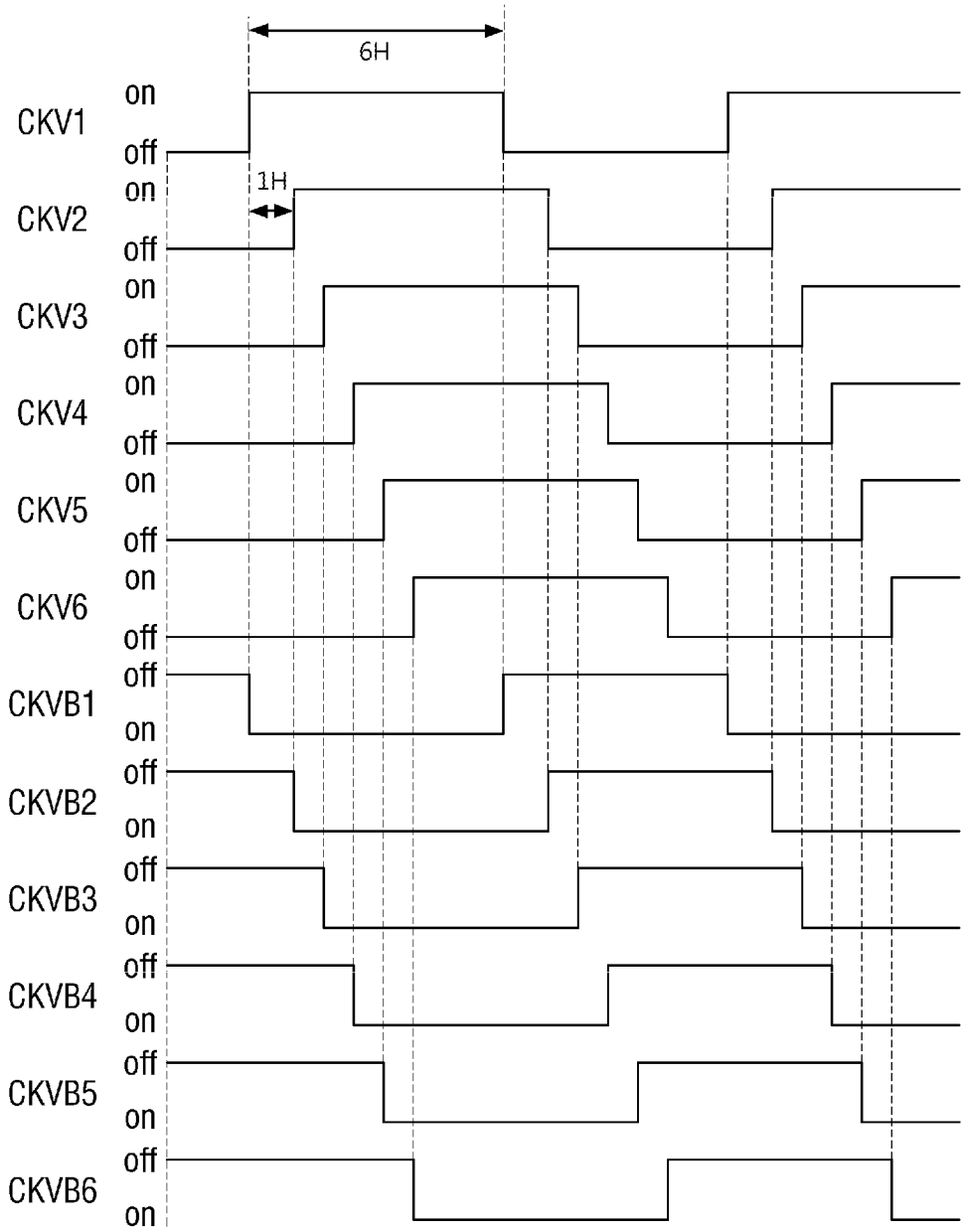
FIG. 3 is a waveform diagram showing waveforms of first to sixth clock signals and first to sixth clock bar signals according to some exemplary embodiments.

FIG. 3 is a waveform diagram showing waveforms of first to sixth clock signals and first to sixth clock bar signals according to some exemplary embodiments.

Referring to FIG. 3, the first clock signal CKV1 is turned on for six horizontal periods 6H, is then turned off for six horizontal periods 6H, is again turned on for six horizontal periods 6H, and so on.

Herein, one horizontal period 1H may refer to a time taken for the data signals D1 to Dn to be written to the pixels PX in one pixel row. It is to be understood that the time taken for the data signals D1 to Dn to be written may vary depending on the scheme for driving the pixel rows in some exemplary embodiments.

The second to sixth clock signals CKV2 to CKV6 may be waveforms that are turned on and off for 6H repeatedly, like the first clock signal CKV1. It is, however, to be noted that the second clock signal CKV2 may have a phase delayed by one horizontal period 1H with respect to the first clock signal CKV1. Likewise, the third clock signal CKV3 may have a phase delayed by one horizontal period 1H with respect to the second clock signal CKV2. The fourth clock signal CKV4 may have a phase delayed by one horizontal period 1H with respect to the third clock signal CKV3. The fifth clock signal CKV5 may have a phase delayed by one horizontal period 1H with respect to the fourth clock signal CKV4. The sixth clock signal CKV6 may have a phase delayed by one horizontal period 1H with respect to the fifth clock signal CKV5.

On the other hand, the first clock bar signal CKVB1 is in antiphase with the first clock signal CKV1. In other words, the first clock bar signal CKVB1 has a phase delayed by six horizontal periods 6H with respect to the first clock signal CKV1. Likewise, the second clock bar signal CKVB2 may be in antiphase with the second clock signal CKV2. The third clock bar signal CKVB3 may be in antiphase with the third clock signal CKV3. The fourth clock bar signal CKVB4 may be in antiphase with the fourth clock signal CKV4. The fifth clock bar signal CKVB5 may be in antiphase with the fifth clock signal CKV5. The sixth clock bar signal CKVB6 may be in antiphase with the sixth clock signal CKV6.

In addition, the first clock bar signal CKVB1 has a phase delayed by one horizontal period 1H with respect to the sixth clock signal CKV6. Accordingly, the first to sixth clock signals CKV1 to CKV6 and the first to sixth clock bar signals CKVB1 to CKVB6, i.e., a total of twelve signals, may be sequentially turned on and sequentially turned off. This scheme may be referred to as six-phase driving. That is, the six-phase driving refers to a scheme using six pairs of signals among the clock signals and clock bar signals CKV1 to CKV6 and CKVB1 to CKVB6 in order to ensure a sufficient time for turning on corresponding switching transistors (not shown) disposed in (or otherwise associated with) each of the pixels.

When the first to sixth clock signals CKV1 to CKV6 and the first to sixth clock bar signals CKVB1 to CKVB6 have waveforms as shown in FIG. 3, in order to sequentially turn on/off the pixels PX disposed on (or in) the display 30 row-by-row, the first to sixth clock signals CKV1 to CKV6 and the first to sixth clock bar signals CKVB1 to CKVB6 may be sequentially applied.

For example, the gate signal G1 generated using the first clock signal CKV1 is provided to the pixels PX in the first row. The gate signal G2 generated using the second clock signal CKV2 is provided to the pixels PX in the second row. The gate signal G3 generated using the third clock signal CKV3 is provided to the pixels PX in the third row. The gate signal G4 generated using the fourth clock signal CKV4 is provided to the pixels PX in the fourth row. The gate signal G5 generated using the fifth clock signal CKV5 is provided to the pixels PX in the fifth row. The gate signal G6 generated using the sixth clock signal CKV6 is provided to the pixels PX in the sixth row. Further, the gate signal G7 formed using the first clock bar signal CKVB1 is provided to the pixels PX in the seventh row. The gate signal G8 generated using the second clock bar signal CKVB2 is provided to the pixels PX in the eighth row. The gate signal G9 generated using the third clock bar signal CKVB3 is provided to the pixels PX in the ninth row. The gate signal G10 generated using the fourth clock bar signal CKVB4 is provided to the pixels PX in the tenth row. The gate signal G11 generated using the fifth clock bar signal CKVB5 is provided to the pixels PX in the eleventh row. The gate signal G12 generated using the sixth clock bar signal CKVB6 is provided to the pixels PX in the twelfth row. Subsequently, the gate signal G13 generated using the first clock signal CKV1 is provided to the pixels PX in the thirteenth row. In this manner, the driving scheme can be carried out.

Although the six-phase driving scheme has been described, it is to be understood that other phase driving is also possible and may be utilized in association with exemplary embodiments. For example, three-phase or four-phase driving may be utilized.

Referring again to FIG. 2, the first to twelfth clock lines 121 to 132 and the first to twelfth bridge lines 141 to 152 may be connected to one another taking into account the colors of the pixels PX disposed in the display area DA.

For example, as shown in FIG. 2, the first clock line 121 provided with the first clock signal CKV1 may be connected to the first bridge line 141. The second clock line 122 provided with the fourth clock signal CKV4 may be connected to the fourth bridge line 144. The third clock line 123 provided with the first clock bar signal CKVB1 may be connected to the seventh bridge line 147. The fourth clock line 124 provided with the fourth clock bar signal CKVB4 may be connected to the tenth bridge line 150. By connecting the lines in the above-described-manner, the first clock signal CKV1, the fourth clock signal CKV4, the first clock bar signal CKVB1, and the fourth clock bar signal CKVB4 provided via the first to fourth clock lines 121 to 124 may be provided to the pixels PX in the first row, the pixels PX in the fourth row, the pixels PX in the seventh row, and the pixels PX in the tenth row, respectively. The pixels PX in the first row, the pixels PX in the fourth row, the pixels PX in the seventh row, and the pixels PX in the tenth row all may display red (R).

By using such a connection structure, it is possible to reduce the difference in length among the bridge lines used for driving the pixels PX displaying the same color. For instance, as the first to fourth clock lines 121 to 124 that provide clock signals to the rows in which the pixels PX displaying red (R) are disposed close to one another, it is possible to reduce a difference in length among the first bridge line 141, the fourth bridge line 144, the seventh bridge line 147, and the tenth bridge line 150 that are connected to the first to fourth clock lines 121 to 124, respectively. As a result, as shown in FIG. 2, the largest difference in length among bridge lines for driving the pixels PX displaying red (R), i.e., the difference in length between the first bridge line 141 and the tenth bridge line 150 is a first distance dt1, which is a relatively small value.

If the first to sixth clock signals CKV1 to CKV6 and the first to sixth clock bar signals CKVB1 to CKVB6 are sequentially applied to the first to twelfth clock lines 121 to 132, and the first to twelfth bridge lines 141 to 152 connect them sequentially, the difference in length between adjacent bridge lines may be greater than the first distance dt1, but less than two times the first distance dt1. To this end, the difference in length between any two bridge lines among the first to twelfth bridge lines 141 to 152 may be less than three times the first distance dt1. As such, the display device according to various exemplary embodiments can reduce the difference in the length to thereby improve display quality.

It is to be understood that the structure capable of improving the display quality may also be applied to the pixels PX displaying green (G) and blue (B), as well as the pixels PX displaying red (R). Additionally, by employing the structure of the first to twelfth clock lines 121 to 132, according to various exemplary embodiments, to reduce the difference in length among the bridge lines, it is not necessary to extend the bridge lines in order to coordinate the lengths of the bridge lines (e.g., to form a zigzag structure), such that the area of the line area LA can be reduced.

Figure 4:
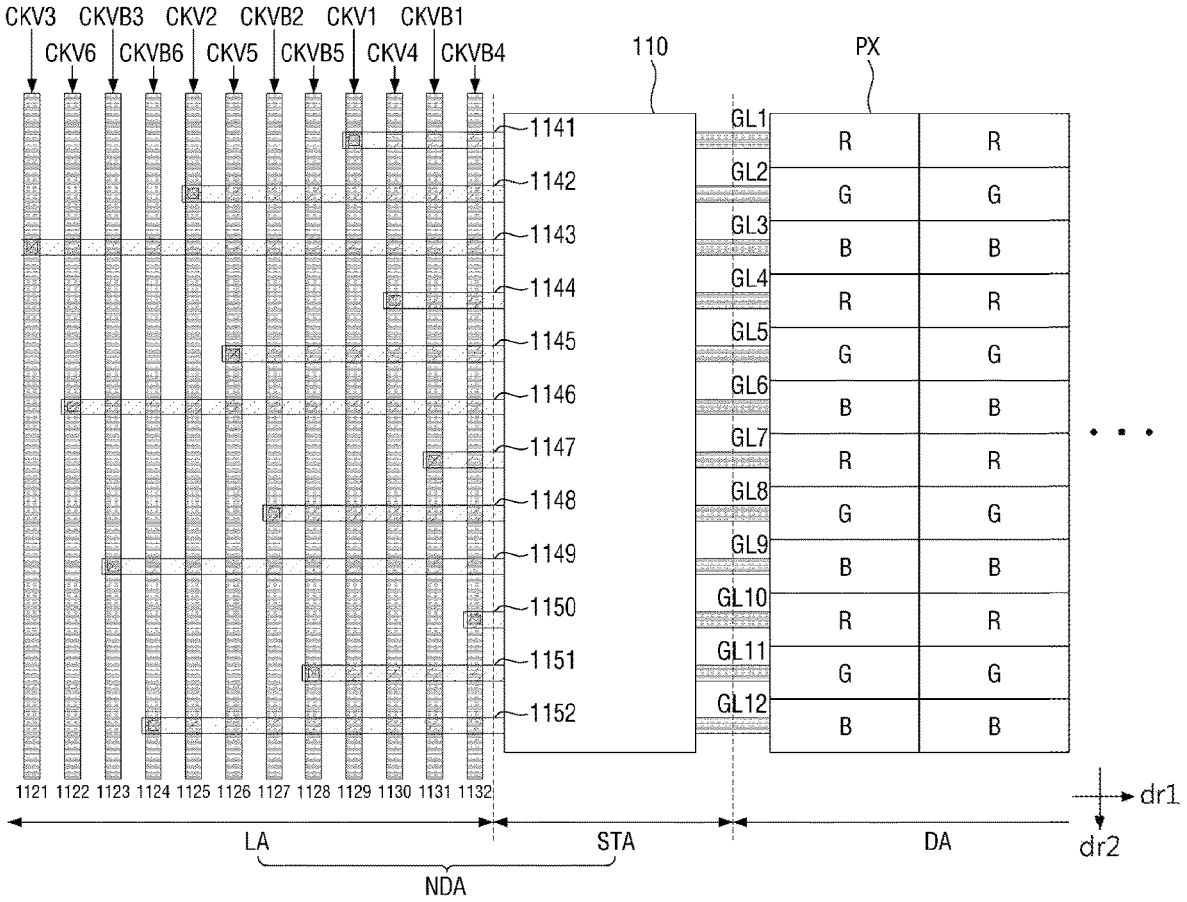
FIG. 4 is a layout diagram showing a portion of a gate driver and a display of a display device according to some exemplary embodiments.

FIG. 4 is a layout diagram showing a portion of a gate driver and a display of a display device according to some exemplary embodiments.

The display device described in association with FIG. 4 is similar to the display device described in association with FIG. 2, except for the type of signals provided to first to twelfth clock lines 1121 to 1132. Therefore, description will be made focusing on the type of signals provided to the first to twelfth clock lines 1121 to 1132, and other elements will not be described again to avoid redundancy. The same description as previously provided can be applied for the same elements.

Referring to FIG. 4, the display device includes first to twelfth clock lines 1121 to 1132 and first to twelfth bridge lines 1141 to 1152 disposed in the non-display area NDA. As shown in FIG. 2, the lengths of the bridge lines (e.g., bridge lines 141, 144, 147, and 150) connected to the stages 111 (see FIG. 1) of the stage unit 110 for generating the gate signals G1 to Gm provided to the pixel rows displaying red (R) is longer than the lengths of the bridge lines (e.g., bridge lines 142, 143, 145, 146, 148, 149, 151, and 152) connected to the stages 111 of the stage unit 110 for generating the gate signals G1 to Gm provided to the pixel rows displaying green (G) and blue (B).

In contrast, as seen in FIG. 4, the lengths of the bridge lines (e.g., bridge lines 1141, 1144, 1147, and 1150) connected to the stages 111 of the stage unit 110 for generating the gate signals G1 to Gm provided to the pixel rows displaying red (R) may be shorter than the lengths of the bridge lines (e.g., bridge lines 1142, 1143, 1145, 1146, 1148, 1149, 1151, and 1152) connected to the stages 111 of the stage unit 110 for generating the gate signals G1 to Gm provided to the pixel rows displaying green (G) and blue (B).

To this end, the first clock line 1121 may be provided with the third clock signal CKV3, the second clock line 1122 may be provided with the sixth clock signal CKV6, the third clock line 1123 may be provided with the third clock bar signal CKVB3, and the fourth clock line 1124 may be provided with the sixth clock bar signal CKVB6. These first to fourth clock lines 1121 to 1124 may be connected to the stages 111 for providing the gate signals G1 to Gm to the pixels PX displaying blue (B).

Likewise, the fifth clock line 1125 may be provided with the second clock signal CKV2. The sixth clock line 1126 may be provided with the fifth clock signal CKV5. The seventh clock line 1127 may be provided with the second clock bar signal CKVB2. The eighth clock line 1128 may be provided with the fifth clock bar signal CKVB5. These fifth to eighth clock lines 1125 to 1128 may be connected to the stages 111 of the stage unit 110 for providing the gate signals G1 to Gm to the pixels PX displaying blue (B).

In addition, the ninth clock line 1129 may be provided with the first clock signal CKV1. The tenth clock line 1130 may be provided with the fourth clock signal CKV4. The eleventh clock line 1131 may be provided with the first clock bar signal CKVB1. The twelfth clock line 1132 may be provided with the fourth clock bar signal CKVB4. These ninth to twelfth clock lines 1129 to 1132 may be connected to the stages 111 of the stage unit 110 for providing the gate signals G1 to Gm to the pixels PX displaying blue (B).

Figure 5:
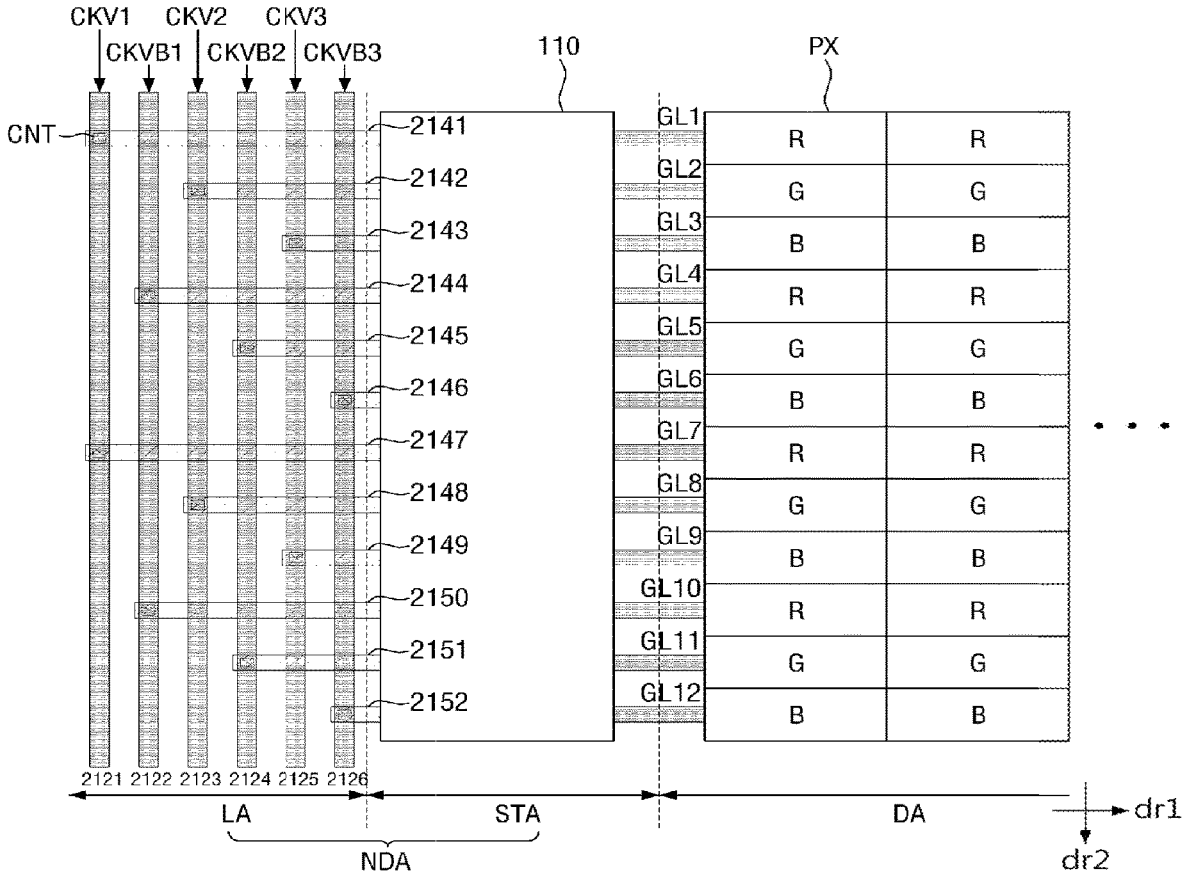
FIG. 5 is a layout diagram showing a portion of a gate driver and a display of a display device according to some exemplary embodiments.

FIG. 5 is a layout diagram showing a portion of a gate driver and a display of a display device according to some exemplary embodiments.

The display device described in association with FIG. 5 is similar to the display device described in association with FIG. 2, except that the display device described in association with FIG. 5 includes first to sixth clock lines 2121 to 2126 versus first to twelfth clock lines 141 to 152. Therefore, description will be made focusing on the first to sixth clock lines 2121 to 2126, and other elements will not be described again to avoid redundancy. The same description as previously provided can be applied for the same elements.

Referring to FIG. 5, the display device includes first to sixth clock lines 2121 to 2126 and first to twelfth bridge lines 2141 to 2152 disposed in the non-display area NDA.

As described in association with FIG. 2, the stage unit 110 is driven with the first to sixth clock signals CKV1 to CKV6 and the first to sixth clock bar signals CKVB1 to CKVB6. In other words, the six-phase driving scheme is used. In contrast, the stage unit 110 of FIG. 5 may be driven with the first to third clock signals CKV1 to CKV3 and the first to third clock bar signals CKVB1 to CKVB3. In other words, a three-phase driving scheme may be used.

To this end, the first clock line 2121 may be provided with the first clock signal CKV1. The second clock line 2122 may be provided with the first clock bar signal CKVB1. These first and second clock lines 2121 and 2122 may be connected to the stages 111 of the stage unit 110 for providing the gate signals G1 to Gm to the pixels PX displaying red (R).

Likewise, the third clock line 2123 may be provided with the second clock signal CKV2. The fourth clock line 2124 may be provided with the second clock bar signal CKVB2. These third and fourth clock lines 2123 and 2124 may be connected to the stages 111 of the stage unit 110 for providing the gate signals G1 to Gm to the pixels PX displaying green (G).

In addition, the fifth clock line 2125 may be provided with the third clock signal CKV3. The sixth clock line 2126 may be provided with the third clock bar signal CKVB3. These fifth and sixth clock lines 2125 and 2126 may be connected to the stages 111 of the stage unit 110 for providing the gate signals G1 to Gm to the pixels PX displaying red (R).

Figure 6:
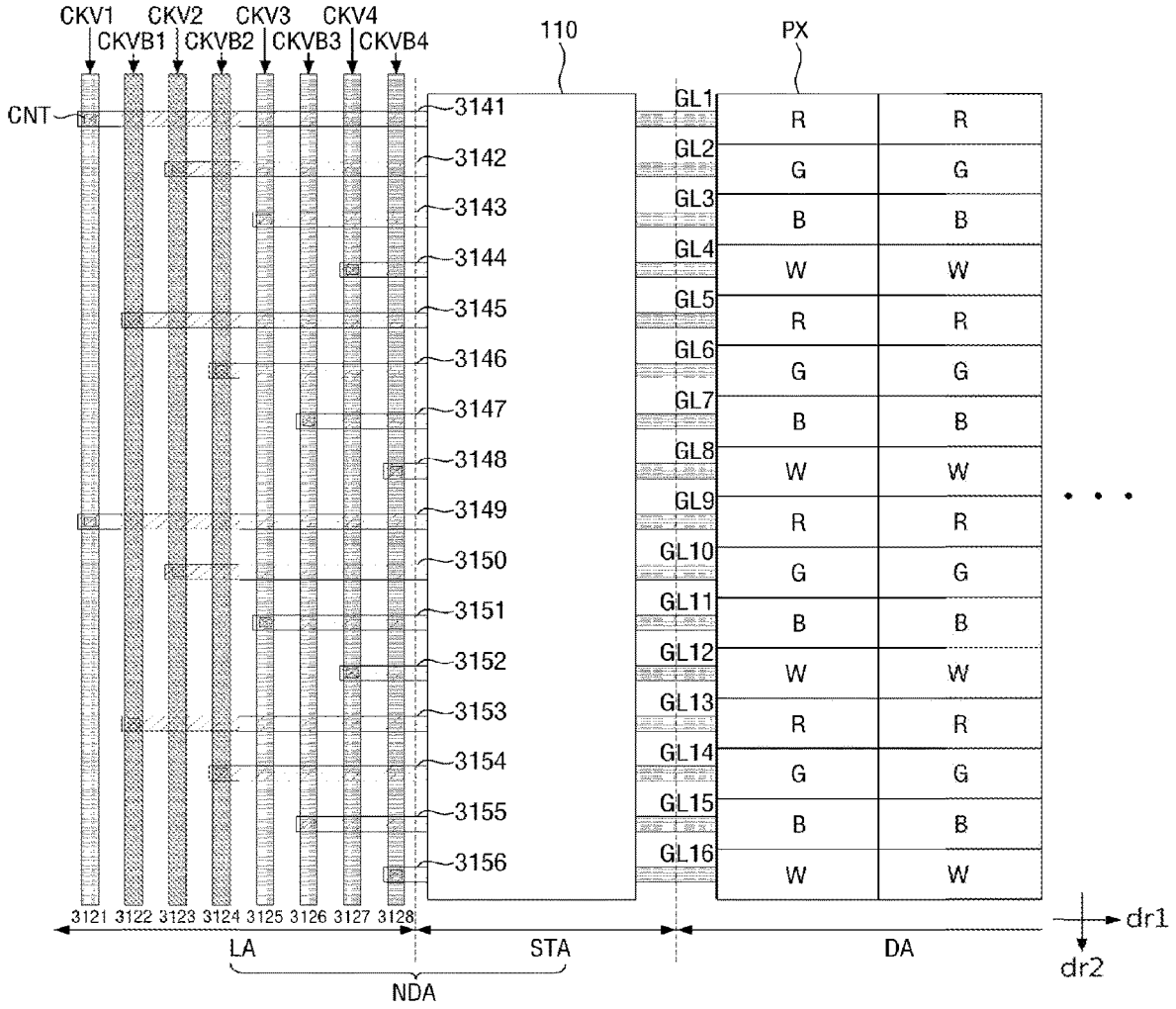
FIG. 6 is a layout diagram showing a portion of a gate driver and a display of a display device according to some exemplary embodiments.

FIG. 6 is a layout diagram showing a portion of a gate driver and a display of a display device according to some exemplary embodiments.

The display device described in association with FIG. 6 is similar to the display device described in association with FIG. 2, except that the display device described in association with FIG. 6 further includes pixels PX for displaying white (W). In addition, the display device described in association with FIG. 6 is driven by a four-phase driving scheme. Therefore, description will be made focusing on the pixels for displaying white, and other elements will not be described again to avoid redundancy. The same description as previously provided can be applied for the same elements.

Referring to FIG. 6, the display device includes first to eighth clock lines 3121 to 3128 and first to sixteenth bridge lines 3141 to 3156 disposed in the non-display area NDA.

Unlike the display device described in association with FIG. 2 that drives three types of pixels PX displaying red (R), green (G) and blue (B), the display device described with reference to FIG. 6 further includes pixels PX for displaying white (W), as well as pixels PX for displaying red (R), green (G), and blue (B). Accordingly, a driving scheme with a phase of a multiple of four may be employed. That is, a four-phase driving scheme may be employed.

To this end, the first clock line 3121 may be provided with the first clock signal CKV1, and the second clock line 3122 may be provided with the first clock bar signal CKVB1. These first and second clock lines 3121 and 3122 may be connected to the stages 111 of the stage unit 110 for providing the gate signals G1 to Gm to the pixels PX displaying red (R).

Likewise, the third clock line 3123 may be provided with the second clock signal CKV2, and the fourth clock line 3124 may be provided with the second clock bar signal CKVB2. These third and fourth clock lines 3123 and 3124 may be connected to the stages 111 of the stage unit 110 for providing the gate signals G1 to Gm to the pixels PX displaying green (G).

In addition, the fifth clock line 3125 may be provided with the third clock signal CKV3, and the sixth clock line 3126 may be provided with the third clock bar signal CKVB3. These fifth and sixth clock lines 3125 and 3126 may be connected to the stages 111 of the stage unit 110 for providing the gate signals G1 to Gm to the pixels PX displaying blue (B).

Further, the seventh clock line 3127 may be provided with the fourth clock signal CKV4, and the eighth clock line 3128 may be provided with the fourth clock bar signal CKVB4. These seventh and eighth clock lines 3127 and 3128 may be connected to the stages 111 of the stage unit 110 for providing the gate signals G1 to Gm to the pixels PX displaying white (W).

Figure 7:
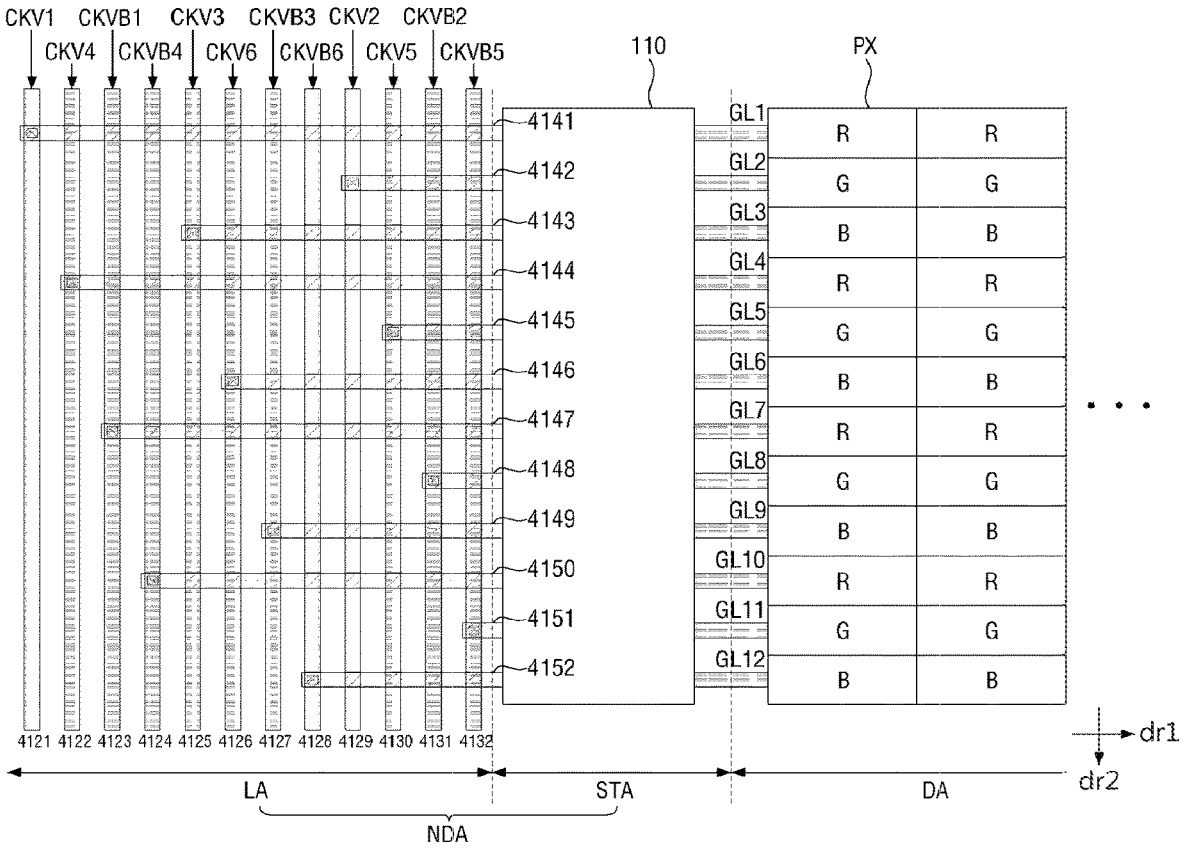
FIG. 7 is a layout diagram showing a portion of a gate driver and a display of a display device according to some exemplary embodiments.

FIG. 7 is a layout diagram showing a portion of a gate driver and a display of a display device according to some exemplary embodiments.

The display device described in association with FIG. 7 is similar to the display device described in association with FIG. 2, except for the type of signals provided to first to twelfth clock lines 4121 to 4132. Therefore, description will be made focusing on the type of signals provided to the first to twelfth clock lines 4121 to 4132, and other elements will not be described again to avoid redundancy. The same description as previously provided can be applied for the same elements.

Referring to FIG. 7, the display device includes first to twelfth clock lines 4121 to 4132 and first to twelfth bridge lines 4141 to 4152 disposed in the non-display area NDA.

As described in association with FIG. 2, the lengths of the bridge lines connected to the stages 111 of the stage unit 110 for generating the gate signals G1 to Gm provided to the pixel rows displaying red (R) is longer than the lengths of the bridge lines connected to the stages 111 of the stage unit 110 for generating the gate signals G1 to Gm provided to the pixel rows displaying the green (G) and blue (B). In contrast, as seen in FIG. 7, the lengths of the bridge lines (e.g., bridge lines 4142, 4145, 4148, and 4151) connected to the stages 111 of the stage unit 110 for generating the gate signals G1 to Gm provided to the pixel rows displaying green (G) may be shorter than the lengths of the bridge lines (e.g., bridge lines 4141, 4143, 4144, 4146, 4147, 4149, 4150, and 4152) connected to the stages 111 of the stage unit 110 for generating the gate signals G1 to Gm provided to the pixel rows displaying red (R) and blue (B).

To this end, the first clock line 4121 may be provided with the first clock signal CKV1, the second clock line 4122 may be provided with the fourth clock signal CKV4, the third clock line 4123 may be provided with the first clock bar signal CKVB1, and the fourth clock line 4124 may be provided with the fourth clock bar signal CKVB4. These first to fourth clock lines 4121 to 4124 may be connected to the stages 111 of the stage unit 110 for providing the gate signals G1 to Gm to the pixels PX displaying red (R).

In addition, the fifth clock line 4125 may be provided with the third clock signal CKV3, the sixth clock line 4126 may be provided with the sixth clock signal CKV6, the seventh clock line 4127 may be provided with the third clock bar signal CKVB3, and the eighth clock line 4128 may be provided with the sixth clock bar signal CKVB6. These fifth to eighth clock lines 4125 to 4128 may be connected to the stages 111 of the stage unit 110 for providing the gate signals G1 to Gm to the pixels PX displaying blue (B).

In addition, the ninth clock line 4129 may be provided with the second clock signal CKV2, the tenth clock line 4130 may be provided with the fifth clock signal CKV5, the eleventh clock line 4131 may be provided with the second clock bar signal CKVB2, and the twelfth clock line 4132 may be provided with the fifth clock bar signal CKVB5. These ninth to twelfth clock lines 4129 to 4132 may be connected to the stages 111 of the stage unit 110 for providing the gate signals G1 to Gm to the pixels PX displaying green (G).

Although certain exemplary embodiments and implementations have been described herein, other embodiments and modifications will be apparent from this description. Accordingly, the inventive concepts are not limited to such embodiments, but rather to the broader scope of the presented claims and various obvious modifications and equivalent arrangements.

What is claimed is:

1. A display device comprising:

pixels disposed in a display area, the pixels being arranged in a first direction and a second direction intersecting the first direction to form a matrix arrangement, each pixel among the pixels being configured to display a color among first to third colors;

gate lines extending in the first direction in the display area, the gate lines being sequentially arranged in the second direction and connected to the pixels;

a stage unit comprising stages, the stage unit being connected to the gate lines and disposed in a non-display area outside the display area;

first to sixth clock lines configured to receive first to third clock signals and first to third clock bar signals to control the stage unit, the first to sixth clock lines extending in the second direction in the non-display area and being sequentially arranged in the first direction; and bridge lines connecting the first to sixth clock lines with the stage unit, wherein the pixels comprise:

a first pixel and a second pixel configured to display the first color;

a third pixel and a fourth pixel configured to display the second color; and a fifth pixel and a sixth pixel configured to display the third color, and wherein:

the first clock line is connected to a first stage among the stages, the first stage being connected to the first pixel;

the second clock line is connected to a second stage among the stages, the second stage being connected to the second pixel;

the third clock line is connected to a third stage among the stages, the third stage being connected to the third pixel;

the fourth clock line is connected to a fourth stage among the stages, the fourth stage being connected to the fourth pixel;

the fifth clock line is connected to a fifth stage among the stages, the fifth stage being connected to the fifth pixel; and the sixth clock line is connected to a sixth stage among the stages, the sixth stage being connected to the sixth pixel, and wherein:

the second clock signal is delayed from the first clock signal; and the third clock signal is delayed from the second clock signal.

2. The display device of claim 1, wherein, among the pixels:

pixels arranged consecutively in the first direction display a same color; and pixels arranged consecutively in the second direction display different colors.

3. The display device of claim 1, wherein a difference in length between the bridge line connected to the first clock line and the bridge line connected to the second clock line is smaller than a difference in length between the bridge line connected to the first clock line and the bridge line connected to the third clock line.

4. The display device of claim 1, wherein:

the first to third clock signals comprise an on-level amplitude for at least three consecutive horizontal periods;

the on-level amplitude of the first clock signal overlaps with the on-level amplitude of the second clock signal for at least two of the at least three horizontal periods; and the on-level amplitude of the second clock signal overlaps with the on-level amplitude of the third clock signal for at least two of the at least three horizontal periods.

5. The display device of claim 4, wherein:

the first clock bar signal is in antiphase with the first clock signal;

the second clock bar signal is in antiphase with the second clock signal; and the third clock bar signal is in antiphase with the third clock signal.

6. The display device of claim 5, wherein:

the on-level amplitude of the third clock signal overlaps with an on-level amplitude of a fourth clock signal for at least two horizontal periods;

the on-level amplitude of the fourth clock signal overlaps with an on-level amplitude of a fifth clock signal for at least two horizontal periods; and the on-level amplitude of the fifth clock signal overlaps with an on-level amplitude of a sixth clock signal for at least two horizontal periods.

7. The display device of claim 5, wherein:

the first clock line is provided with the first clock signal;

the second clock line is provided with the first clock bar signal;

the third clock line is provided with the second clock signal;

the fourth clock line is provided with the second clock bar signal;

the fifth clock line is provided with the third clock signal; and the sixth clock line is provided with the third clock bar signal.

8. The display device of claim 1, wherein:

the first color is one of red, green, and blue;

the second color is different than the first color, the second color being one of red, green, and blue; and the third color is different than the first color and the second color, the third color being one of red, green, and blue.

9. The display device of claim 1, further comprising:

seventh and eighth clock lines, wherein:

the pixels further comprise a seventh and an eighth pixel configured to display a fourth color;

the seventh clock line is connected to a seventh stage among the stages, the seventh stage being connected to the seventh pixel; and the eighth clock line is connected to an eighth stage among the stages, the eighth stage being connected to the eighth pixel.

10. A display device comprising:

pixels disposed in a display area, the pixels being arranged in a first direction and a second direction intersecting the first direction to form a matrix arrangement, each pixel among the pixels being configured to display a color among first to third colors;

gate lines extending in the first direction in the display area, the gate lines being sequentially arranged in the second direction and connected to the pixels;

a stage unit comprising stages, the stage unit being connected to the gate lines and disposed in a non-display area outside the display area;

first to $c^{th}$ clock lines configured to receive clock signals and clock bar signals to control the stage unit, the first to $c^{th}$ clock lines extending in the second direction in the non-display area and being sequentially arranged in the first direction; and bridge lines connecting the first to $c^{th}$ clock lines with the stage unit, wherein the pixels comprise:

a first pixel to an $a^{th}$ pixel configured to display the first color;

a $(a+1)^{th}$ pixel and a $b^{th}$ pixel configured to display the second color; and a $(b+1)^{th}$ pixel and a $c^{th}$ pixel configured to display the third color, wherein:

the first to $a^{th}$ clock lines among the first to $c^{th}$ clock lines are connected to first to $a^{th}$ stages among the stages, the first to $a^{th}$ stages being connected to the first pixel to the $a^{th}$ pixel;

the $(a+1)^{th}$ to $b^{th}$ clock lines among the first to $c^{th}$ clock lines are connected to $(a+1)^{th}$ to $b^{th}$ stages among the stages, the $(a+1)^{th}$ to $b^{th}$ stages being connected to the $(a+1)^{th}$ pixel to the $b^{th}$ pixel; and the $(b+1)^{th}$ to $c^{th}$ clock lines among the first to $c^{th}$ clock lines are connected to $(b+1)^{th}$ to $c^{th}$ stages among the stages, the $(b+1)^{th}$ to $c^{th}$ stages being connected to the $(b+1)^{th}$ pixel to the $c^{th}$ pixel, and wherein:

a, b, and c are natural numbers that satisfy $1<a<b<c$;

a second clock signal among the clock signals is delayed from a first clock signal among the clock signals; and a third clock signal among the clock signals is delayed from the second clock signal.

11. The display device of claim 10, wherein:

two stages among the stages are connected to two bridge lines among the bridge lines;

the two bridge lines are consecutively arranged in the second direction;

the two stages are connected to two pluralities of pixels among the pixels;

each pixel among a corresponding plurality of pixels among the two pluralities of pixels is configured to display a same color; and the two pluralities of pixels are configured to display different colors.

12. The display device of claim 10, wherein the bridge lines respectively connected to the first clock line, the $(a+1)^{th}$ clock line, and the $(b+1)^{th}$ clock line are consecutively arranged in the second direction.

13. The display device of claim 10, wherein a difference in length between the bridge line connected to the first clock line and the bridge line connected to the $a^{th}$ clock line is smaller than a difference in length between the bridge line connected to the first clock line and the bridge line connected to the $(a+1)^{th}$ clock line.

14. The display device of claim 10, wherein, among the pixels:

pixels arranged consecutively in the first direction display a same color; and pixels arranged consecutively in the second direction display different colors.

15. The display device of claim 14, wherein three consecutive pixels arranged in the second direction display different colors.

16. The display device of claim 14, wherein three consecutive pixels arranged in the second direction display the first to third colors, respectively.

17. The display device of claim 10, wherein:

the first color is one of red, green, and blue;

the second color is different than the first color, the second color being one of red, green, and blue; and the third color is different than the first color and the second color, the third color being one of red, green, and blue.

18. The display device of claim 10, wherein:

the first color is one of cyan, magenta, and yellow;

the second color is different than the first color, the second color being one of cyan, magenta, and yellow; and the third color is different than the first color and the second color, the third color being one of cyan, magenta, and yellow.

19. The display device of claim 10, further comprising:

$(c+1)^{th}$ to $d^{th}$ clock lines, d being a natural number greater than c, wherein:

the pixels further comprise a $(c+1)^{th}$ pixel to a $d^{th}$ pixel configured to display a fourth color; and the $(c+1)^{th}$ to $d^{th}$ clock lines are connected to $(c+1)^{th}$ to $d^{th}$ stages among the stages, the $(c+1)^{th}$ to $d^{th}$ stages being connected to the $(c+1)^{th}$ to $d^{th}$ pixels.

* * * * *